US010395861B2

(12) United States Patent
Chen

(10) Patent No.: US 10,395,861 B2
(45) Date of Patent: Aug. 27, 2019

(54) KEY STRUCTURE

(71) Applicant: ASUSTeK COMPUTER INC., Taipei (TW)

(72) Inventor: Yu-Kuang Chen, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 15/923,281

(22) Filed: Mar. 16, 2018

(65) Prior Publication Data

US 2018/0277321 A1 Sep. 27, 2018

(30) Foreign Application Priority Data

Mar. 24, 2017 (TW) ..... 106110022 A

(51) Int. Cl.
*H01H 13/704* (2006.01)

(52) U.S. Cl.
CPC ..... *H01H 13/704* (2013.01); *H01H 2207/008* (2013.01); *H01H 2207/016* (2013.01); *H01H 2207/018* (2013.01); *H01H 2207/028* (2013.01); *H01H 2209/002* (2013.01); *H01H 2211/004* (2013.01)

(58) Field of Classification Search
CPC ..... H01H 13/704; H01H 2207/008; H01H 2207/016; H01H 2209/002; H01H 13/7006; H01H 9/00; H01H 2207/018; H01H 2219/06
USPC ..... 200/341
See application file for complete search history.

(56) References Cited

U.S. PATENT DOCUMENTS 7,034,232 B2 4/2006 Ide et al.
7,999,203 B2 * 8/2011 Cheng ..... H01H 9/182 200/310
8,222,545 B2 * 7/2012 Tsai ..... G06F 3/0202 200/5 A
8,569,640 B2 * 10/2013 Yamada ..... H01H 3/125 200/302.1
9,852,853 B2 * 12/2017 Armendariz ..... H01H 13/703
10,121,611 B2 * 11/2018 Cheng ..... H01H 13/02
(Continued)

FOREIGN PATENT DOCUMENTS

CN 201435869 Y 3/2010
CN 203205306 U 9/2013
(Continued)

*Primary Examiner* — Edwin A. Leon
(74) *Attorney, Agent, or Firm* — McClure, Qualey & Rodack, LLP

(57) ABSTRACT

A key structure having a pressing area is provided. The key structure includes a first membrane and a second membrane. A first conductive layer and a first insulation layer are sequentially disposed on a surface of the first membrane. The first insulation layer has a first opening in the pressing area, so that a part of the first conductive layer is exposed from the first opening. The second membrane is disposed opposite to the first membrane. A second conductive layer and a second insulation layer are sequentially disposed on a surface of the second membrane facing the first membrane. The second insulation layer has a second opening, which is formed corresponding to the first opening, in the pressing area, so that a part of the second conductive layer is exposed from the second opening to face the first conductive layer in the first opening.

9 Claims, 4 Drawing Sheets

(56) References Cited

U.S. PATENT DOCUMENTS

| | | | | |
|---|---|---|---|---|
| 2009/0159412 | A1* | 6/2009 | Liu | H01H 13/84<br>200/302.3 |
| 2013/0258504 | A1* | 10/2013 | Wang | G02B 7/025<br>359/819 |

FOREIGN PATENT DOCUMENTS

| | | | |
|---|---|---|---|
| TW | I1273867 | B | 2/2007 |
| TW | 201435869 | Y | 3/2010 |
| TW | M439209 | U1 | 10/2012 |

* cited by examiner

KEY STRUCTURE

CROSS-REFERENCE TO RELATED APPLICATION

This application claims the priority benefit of TW application serial No. 106110022, filed on Mar. 24, 2017. The entirety of the above-mentioned patent applications are hereby incorporated by references herein and made a part of specification.

BACKGROUND

Technical Field

The present invention relates to a key structure.

Related Art

Currently, a membrane switch is commonly used as keyboard switches in a bottom circuit structure of a keyboard in a computer. A common membrane switch structure includes three layers of insulation membranes, with every two insulation membranes being bonded by a waterproof glue. Therefore, two layers of waterproof glue need to be used to bind the three layers of insulation membranes.

However, limited by the thickness of the three layers of polyethylene terephthalate (PET) material, it is difficult to reduce the thickness of the membrane switch. Besides, because the membrane switch requires two bonding processes using a waterproof glue, the yield of products cannot be improved easily. In addition, if the size of the opening in the middle layer of insulation membrane needs to be changed, a new mold needs to be opened for the middle layer of insulation membrane, making it difficult to reduce production costs.

SUMMARY

According to one aspect of the disclosure, a key structure having a pressing area is provided. The key structure comprises: a first membrane and a second membrane, disposed opposite to the first membrane. A first conductive layer and a first insulation layer are sequentially disposed on a surface of the first membrane. The first insulation layer has a first opening in the pressing area. A part of the first conductive layer is exposed from the first opening. A second conductive layer and a second insulation layer are sequentially disposed on a surface of the second membrane facing the first membrane, and the second insulation layer has a second opening corresponding to the first opening in the pressing area, and a part of the second conductive layer is exposed from the second opening to face the first conductive layer in the first opening.

In embodiments, the key structure has the first membrane and the second membrane disposed opposite to each other. The first conductive layer of the first membrane can be exposed from the first opening of the first insulation layer. The second conductive layer of the second membrane can be exposed from the second opening of the second insulation layer. Therefore, when the first membrane in the pressing area is pressed, the first conductive layer can move toward the second membrane along with the bending deformation of the first membrane to enter into contact with the second conductive layer, thereby achieving conduction. In this way, the number of layers of membranes of the key structure is reduced, reducing the thickness of the key structure and improving the yield of the key structure. In addition, if the sizes of the first opening and the second opening need to be changed, only the first insulation layer and the second insulation layer in the pressing area need to be re-patterned, and no new mold needs to be opened, so that production costs can be reduced.

DETAILED DESCRIPTION

The following describes a plurality of implementations of the present invention with reference to the accompanying drawings. Some common structures and components may be shown in simple and schematic manners.

Figure 1:
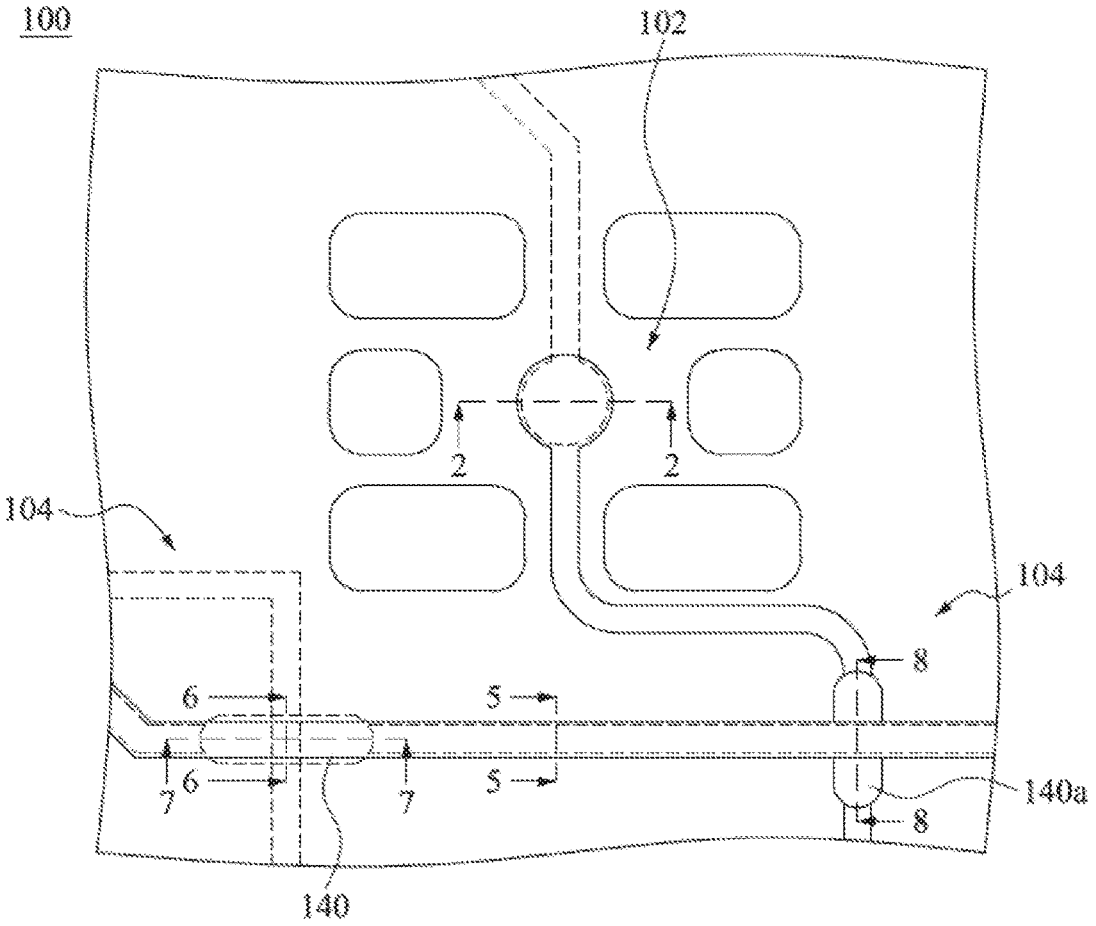
FIG. 1 is a top view of a key structure according to an implementation of the present invention.
Figure 2:
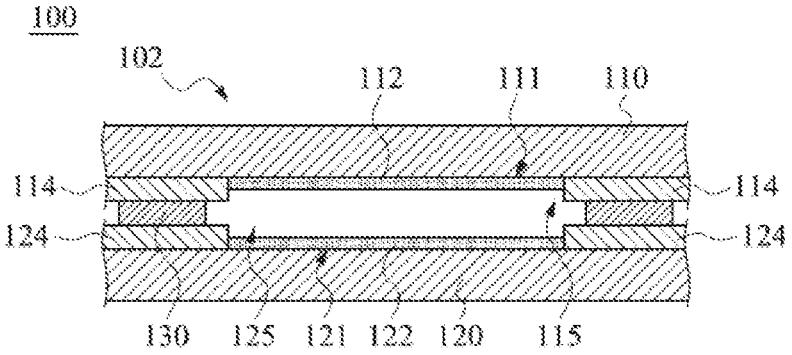
FIG. 2 is a cross-sectional view of the key structure in FIG. 1 along line 2-2.

FIG. 1 is a top view of a key structure 100 according to an implementation of the present invention. FIG. 2 is a cross-sectional view of the key structure 100 in FIG. 1 along line 2-2. Referring to FIG. 1 and FIG. 2, the key structure 100 has a pressing area 102 and a shielding area 104. The shielding area 104 is adjacent to the pressing area 102. In an embodiment, the pressing area 102 is surrounded by the shielding area 104. The pressing area 102 is used as a pressing area for a user to operate the key structure 100. A keycap and a switch for sensing a pressing signal are disposed in the pressing area 102. The shielding area 104 is an area other than the pressing area 102. A wire electrically connected with the switch is disposed in the shielding area 104. The key structure 100 includes a first membrane 110 and a second membrane 120. A first conductive layer 112 and a first insulation layer 114 are sequentially disposed on a surface 111 of the first membrane 110. An upper-layer circuit shown in FIG. 1 by using a solid line is the first conductive layer 112. In the shielding area 104, the first conductive layer 112 is covered by the first insulation layer 114. In the pressing area 102, the first insulation layer 114 has a first opening 115 for exposing a part of the first conductive layer 112. The second membrane 120 and the first membrane 110 are disposed opposite to each other. In an embodiment, the second membrane 120 is parallel to and overlaps the first membrane 110.

A second conductive layer 122 and a second insulation layer 124 are sequentially disposed on a surface 121 of the second membrane 120 facing the first membrane 110. A lower-layer circuit shown in FIG. 1 by using a dashed line is the second conductive layer 122. In the shielding area 104, the first conductive layer 112 is covered by the first insulation layer 114. In the pressing area 102, the second insulation layer 124 has a second opening 125A, and part of the second conductive layer 122 is exposed from the second opening 125 to face the first conductive layer 112 that exposed from the first opening 115. In the embodiment, the position of the second opening 125 of the second insulation layer 124 corresponds to the position of the first opening 115 of the first insulation layer 114.

With such a design, the first conductive layer 112 that exposed from the first opening 115 and the second conductive layer 122 that exposed form the second opening 125 may be used as the switch sensing a pressing signal in the key structure 100. In the following description, the state of the key structure 100 in use will be illustrated.

Figure 3:
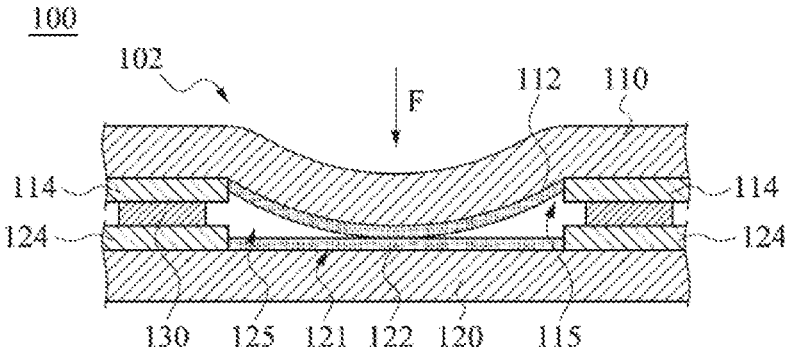
FIG. 3 is a schematic diagram of the key structure in FIG. 2 when a pressing area is pressed.

FIG. 3 is a schematic diagram of the key structure 100 in FIG. 2 when the pressing area 102 is pressed. As shown in the figure, when a user applies a force F to press the first membrane 110 at the upper side of the key structure 100, the first membrane 110 in the pressing area 102 is bent and deformed to move toward the second membrane 120. At the same time, the first conductive layer 112 on the first membrane 110 further moves along with the bending of the first membrane 110 to contact the second conductive layer 122 in the second opening 125, thereby achieving conduction. In this way, the key structure 100 generates a pressing signal.

Compared with a conventional key structure having three layers of membranes, the key structure 100 provide a switch function in the pressing area 102 by using only two layers of membranes (that is, the first membrane 110 and the second membrane 120), thereby effectively reducing the thickness of the key structure 100 and improving the assembly yield of the key structure 100. In addition, if the sizes of the first opening 115 and the second opening 125 need to be changed, only the first insulation layer 114 and the second insulation layer 124 in the pressing area 102 need to be re-patterned, and no new mold needs to be opened, so that production costs can be reduced.

In an embodiment, materials of the first membrane 110 and the second membrane 120 may be polyethylene terephthalate (PET) and the first insulation layer 114 and the second insulation layer 124 are an ultraviolet-curable glue, which is not limited herein. In an embodiment, the key structure 100 further includes an adhesive layer 130. The adhesive layer 130 is located between the first insulation layer 114 and the second insulation layer 124 for bonding the first insulation layer 114 to the second insulation layer 124. In this embodiment, the adhesive layer 130 is a waterproof glue. The key structure 100 only needs two layers of membranes (that is, the first membrane 110 and the second membrane 120). Therefore, only one adhesive layer 130 is needed to bond the first membrane 110 to the second membrane 120, thereby effectively reducing the thickness of the key structure 100 and improving the assembly yield of the key structure 100.

During the manufacture of the key structure 100, the first conductive layer 112 and the second conductive layer 122 are printed on the first membrane 110 and the second membrane 120 respectively. Then, the first insulation layer 114 and the second insulation layer 124 are coated on the first membrane 110 and the second membrane 120 respectively, so that the first insulation layer 114 covers the first conductive layer 112 and the second insulation layer 124 covers the second conductive layer 122. The first opening 115 and the second opening 125 are formed by patterning the first insulation layer 114 and the second insulation layer 124 in the pressing area 102. The first conductive layer 112 is exposed from the first opening 115 and the second conductive layer 122 is exposed from the second opening 125. For example, when the first insulation layer 114 and the second insulation layer 124 are coated, the pressing area 102 is covered by mask. Alternatively, after the first insulation layer 114 and the second insulation layer 124 are coated, the first opening 115 and the second opening 125 are respectively formed in the first insulation layer 114 and the second insulation layer 124 of the pressing area 102 by using a photolithography technology.

After the first insulation layer 114 and the second insulation layer 124 are formed, an ultraviolet ray may be irradiated to cure the first insulation layer 114 and the second insulation layer 124. Then, the adhesive layer 130 is coated between the first insulation layer 114 and the second insulation layer 124, so that the first membrane 110 and the second membrane 120 are bonded to each other by the adhesive layer 130.

It should be appreciated that the connection relationships and materials of components that have been described above will not be repeated.

Figure 4:
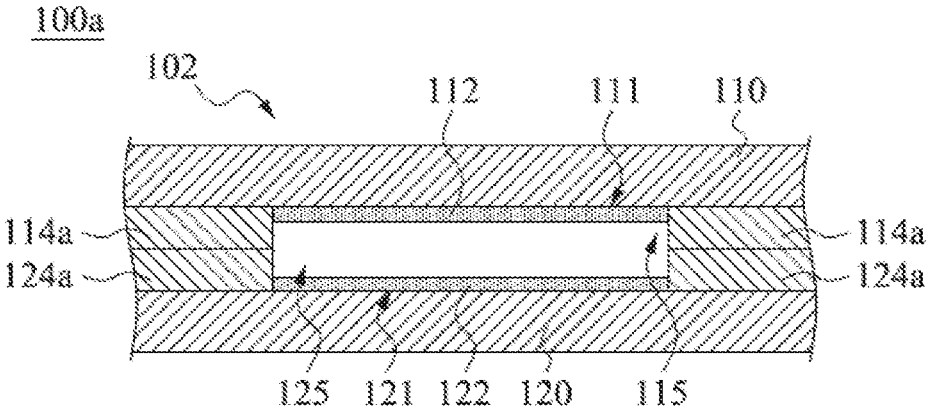
FIG. 4 is a cross-sectional view of a key structure according to an implementation of the present invention.

FIG. 4 is a cross-sectional view of a key structure 100*a* according to an implementation of the present invention. The key structure 100*a* includes a first membrane 110 and a second membrane 120. This implementation is different from the implementation in FIG. 2 in that: the key structure 100*a* does not have an adhesive layer 130. That is, a first insulation layer 114*a* of the key structure 100*a* is in direct contact with a second insulation layer 124*a*. The first membrane 110 and the second membrane 120 of the key structure 100*a* are bonded to each other by means of the first insulation layer 114*a* and the second insulation layer 124*a*. During the manufacture of the key structure 100*a*, after the first insulation layer 114*a* and the second insulation layer 124*a* are respectively coated and patterned on the first membrane 110 and the second membrane 120, the first membrane 110 is stacked on the second membrane 120 and irradiated with an ultraviolet ray, so that the first insulation layer 114*a* is fixed on the second insulation layer 124*a*. Because the key structure 100*a* omits the adhesive layer 130 in FIG. 2, the thickness of the key structure 100*a* can be further reduced.

In FIG. 4, materials of the first insulation layer 114*a* and the second insulation layer 124*a* may be the same. Therefore, there may not necessarily be a junction formed between the first insulation layer 114*a* and the second insulation layer 124*a*.

Figure 5:
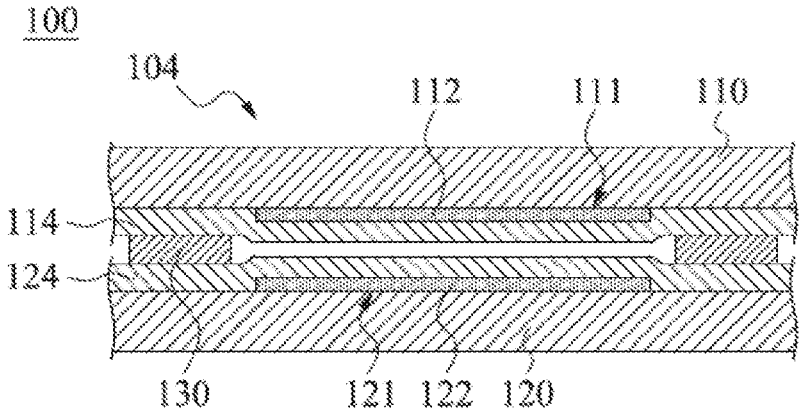
FIG. 5 is a cross-sectional view of the key structure in FIG. 1 along line 5-5.

FIG. 5 is a cross-sectional view of the key structure 100 in FIG. 1 along line 5-5. Referring to FIG. 1 and FIG. 5, the first conductive layer 112 and the second conductive layer 122 extend to the shielding area 104 of the key structure 100. The first conductive layer 112 in the shielding area 104 is located between the first insulation layer 114 and the surface 111 of the first membrane 110, and the second conductive layer 122 in the shielding area 104 is located between the second insulation layer 124 and the surface 121 of the second membrane 120. That is, in the shielding area 104, the first conductive layer 112 is covered by the first insulation layer 114 and the second conductive layer 122 is covered by the second insulation layer 124. The shielding area 104 in the key structure 100 shown in FIG. 5 is designed without jumper. In the following description, a key structure 100 in which the shielding area 104 designed with a jumper is described.

Figure 6:
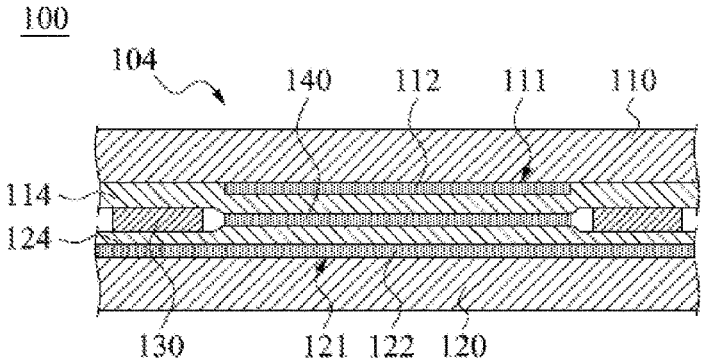
FIG. 6 is a cross-sectional view of the key structure in FIG. 1 along line 6-6.

FIG. 6 is a cross-sectional view of the key structure 100 in FIG. 1 along line 6-6. Referring to FIG. 1 and FIG. 6, the key structure 100 further includes a jumper 140 at the lower layer. The jumper 140 is located in the shielding area 104 and between the first insulation layer 114 and the second insulation layer 124. The first conductive layer 112 is located above the jumper 140.

Figure 7:
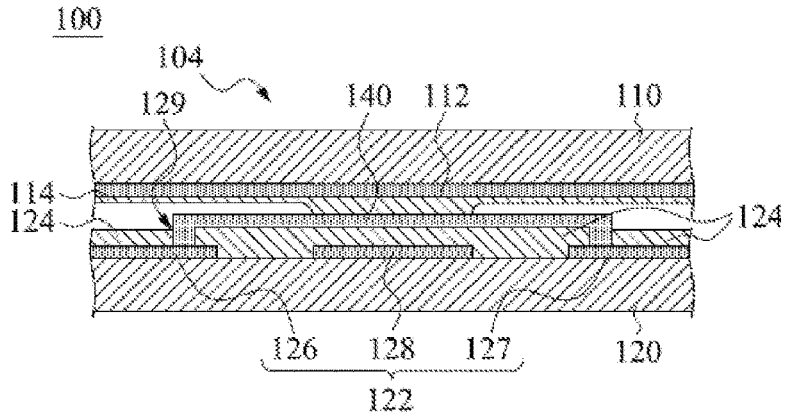
FIG. 7 is a cross-sectional view of the key structure in FIG. 1 along line 7-7.

FIG. 7 is a cross-sectional view of the key structure 100 in FIG. 1 along line 7-7. Referring to FIG. 6 and FIG. 7, in this implementation, the jumper 140 is a wire of the second membrane 120 at the lower layer. The second conductive layer 122 in the shielding area 104 has a first segment 126, a second segment 127, and a third segment 128. There is a space between the first segment 126 and the second segment 127. The third segment 128 is located between the first segment 126 and the second segment 127 and is not in contact with the first segment 126 and the second segment 127. The second insulation layer 124 has two third openings 129, and the two third openings 129 respectively expose the first segment 126 and the second segment 127 of the second conductive layer 122. The jumper 140 is located on the second insulation layer 124 and in electrical contact with the first segment 126 and the second segment 127 that exposed from the two third openings 129, so that the first segment 126 and the second segment 127 of the second conductive layer 122 can be conducted by using the jumper 140. The jumper 140 spans the third segment 128 and the second insulation layer 124 is located between the jumper 140 and the third segment 128, so as to prevent conduction between the jumper 140 and the third segment 128. The first conductive layer 112 is located above the jumper 140.

During the manufacture of the jumper 140, the second insulation layer 124 is patterned to form the two third openings 129 exposing the first segment 126 and the second segment 127 of the second conductive layer 122. Then, the jumper 140 is formed on the second conductive layer 122 in the two third openings 129 and on the second insulation layer 124 between the two third openings 129 by using a printing process.

In other embodiments, the first membrane 110 at the upper layer further includes a jumper. However, to avoid a short circuit, the position where a jumper is disposed on the first membrane 110 does not overlap the position where the jumper 140 is disposed on the second membrane 120 at the lower layer. Refer to the following embodiments.

Figure 8:
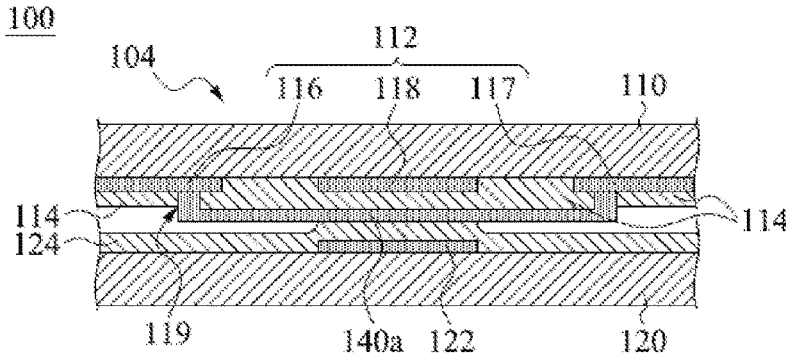
FIG. 8 is a cross-sectional view of the key structure in FIG. 1 along line 8-8.

FIG. 8 is a cross-sectional view of the key structure 100 in FIG. 1 along line 8-8. In this embodiment, the key structure 100 further includes a jumper 140*a* at the upper layer, which is a wire of the first membrane 110 at the upper layer. The first conductive layer 112 in the shielding area 104 has a first segment 116, a second segment 117, and a third segment 118. There is a space between the first segment 116 and the second segment 117. The third segment 118 is located between the first segment 116 and the second segment 117 but not in contact with the first segment 116 and the second segment 117. The first insulation layer 114 has two third openings 119, and the two third openings 119 respectively expose the first segment 116 and the second segment 117 of the first conductive layer 112. The jumper 140*a* is located on the first insulation layer 114 and in electrical contact with the first segment 116 and the second segment 117 that exposed from the two third openings 119, so that the first segment 116 and the second segment 117 of the first conductive layer 112 is conducted by using the jumper 140*a*. The jumper 140*a* spans the third segment 118 and the first insulation layer 114 is located between the jumper 140*a* and the third segment 118, so as to avoid conduction between the jumper 140*a* and the third segment 118. The second conductive layer 122 is located below the jumper 140*a*.

During the manufacture of the jumper 140*a*, the first insulation layer 114 is patterned to form the two third openings 119 exposing the first segment 116 and the second segment 117 of the first conductive layer 112. Then, the jumper 140*a* is formed on the first conductive layer 112 in the two third openings 119 and on the first insulation layer 114 between the two third openings 119 by using a printing process.

The present invention has been disclosed in the foregoing implementations, but the implementations are not intended to limit the present invention. Various modifications and polishing can be made by a person of ordinary skill in the art without departing from the spirit and scope of the present invention. Therefore, the protection scope of the present invention shall subject to the following appended claims.

What is claimed is:

1. A key structure, having a pressing area, the key structure comprising:

a first membrane, having a first conductive layer and a first insulation layer that sequentially disposed on a surface of the first membrane, and the first insulation layer has a first opening in the pressing area, and a part of the first conductive layer is exposed from the first opening;

a second membrane disposed opposite to the first membrane, the second membrane having a second conductive layer and a second insulation layer that sequentially disposed on a surface of the second membrane facing the first membrane, and the second insulation layer has a second opening corresponding to the first opening in the pressing area, and a part of the second conductive layer is exposed from the second opening to face the first conductive layer in the first opening; and a jumper, located in a shielding area and between the first insulation layer and the second insulation layer, wherein the first conductive layer in the shielding area has a first segment and a second segment, the first insulation layer has two third openings for exposing the first segment and the second segment, and the jumper is located on the first insulation layer and is in electrical contacts with the first segment and the second segment that exposed from the two third openings.

2. The key structure according to claim 1, wherein the first insulation layer contacts the second insulation layer.

3. The key structure according to claim 1, further comprising:

an adhesive layer, located between the first insulation layer and the second insulation layer.

4. The key structure according to claim 3, wherein the adhesive layer is a waterproof glue.

5. The key structure according to claim 1, wherein the first insulation layer and the second insulation layer are ultraviolet-curable glue.

6. The key structure according to claim 1, wherein the shielding area is adjacent to the pressing area, and wherein the first conductive layer and the second conductive layer extend into the shielding area, the first conductive layer in the shielding area is located between the first insulation layer and the surface of the first membrane, and the second conductive layer in the shielding area is located between the second insulation layer and the surface of the second membrane.

7. The key structure according to claim 1, wherein the second conductive layer in the shielding area has a first segment and a second segment, the second insulation layer has two third openings for exposing the first segment and the second segment of the second conductive layer, and the jumper is located on the second insulation layer and in electrical contacts the first segment and the second segment of the second conductive layer that exposed from the two third openings of the second insulation layer.

8. The key structure according to claim 1, wherein materials of the first membrane and the second membrane are polyethylene terephthalate.

9. A key structure, having a pressing area, the key structure comprising:

a first membrane, having a first conductive layer and a first insulation layer that sequentially disposed on a surface of the first membrane, and the first insulation layer has a first opening in the pressing area, and a part of the first conductive layer is exposed from the first opening;

a second membrane disposed opposite to the first membrane, the second membrane having a second conductive layer and a second insulation layer that sequentially disposed on a surface of the second membrane facing the first membrane, and the second insulation layer has a second opening corresponding to the first opening in the pressing area, and a part of the second conductive layer is exposed from the second opening to face the first conductive layer in the first opening; and a jumper, located in a shielding area and between the first insulation layer and the second insulation layer, wherein the second conductive layer in the shielding area has a first segment and a second segment, the second insulation layer has two third openings for exposing the first segment and the second segment, and the jumper is located on the second insulation layer and in electrical contacts the first segment and the second segment that exposed from the two third openings.

* * * * *